US010916231B2

(12) United States Patent
Pelleg et al.

(10) Patent No.: US 10,916,231 B2
(45) Date of Patent: Feb. 9, 2021

(54) REVERBERATING PERCUSSION INSTRUMENT

(71) Applicant: SoundFreq LTD, Tel Aviv (IL)

(72) Inventors: Ortal Pelleg, Netanya (IL); Ido Luxman, Tel Aviv (IL)

(73) Assignee: SOUNDFREQ LTD., Tel Aviv (IL)

( * ) Notice: Subject to any disclaimer, the term of this patent is extended or adjusted under 35 U.S.C. 154(b) by 0 days.

(21) Appl. No.: 16/975,966

(22) PCT Filed: Feb. 27, 2019

(86) PCT No.: PCT/IL2019/050220
§ 371 (c)(1),
(2) Date: Aug. 26, 2020

(87) PCT Pub. No.: WO2019/167041
PCT Pub. Date: Sep. 6, 2019

(65) Prior Publication Data

US 2020/0402491 A1 Dec. 24, 2020

(30) Foreign Application Priority Data

Feb. 28, 2018 (IL) ..... 257804

(51) Int. Cl.
*G10H 1/00* (2006.01)
*G10H 3/14* (2006.01)
*G10D 13/10* (2020.01)

(52) U.S. Cl.
CPC ..... *G10H 3/146* (2013.01); *G10D 13/25* (2020.02); *G10D 13/28* (2020.02)

(58) Field of Classification Search
CPC ..... G10H 3/146; G10D 13/28; G10D 13/25
USPC ..... 84/600
See application file for complete search history.

(56) References Cited

U.S. PATENT DOCUMENTS 2,458,193 A * 1/1949 Packheiser ..... G10D 13/08 84/403
3,174,382 A 3/1965 Gugelot et al.
3,589,233 A * 6/1971 Rowe, Sr. ..... G10H 3/20 84/402
3,896,696 A 7/1975 Waters
4,469,003 A * 9/1984 Phelps ..... G10D 13/08 84/404

(Continued)

FOREIGN PATENT DOCUMENTS

FR 2744553 8/1997

OTHER PUBLICATIONS

International Search Report and Written Opinion issued in PCT/IL2019/050220 dated May 19, 2019.

*Primary Examiner* — Jianchun Qin
(74) *Attorney, Agent, or Firm* — Snell & Wilmer LLP

(57) ABSTRACT

A reverberating percussion instrument has a resonating chamber of a completely smoothly contoured configuration to facilitate generation of long-duration pitched reverberations, and a plurality of hollow and substantially mutually parallel vibratable tubes of different lengths, each of which being suspended from an element of the resonating chamber by a tensioned filament at each longitudinal end thereof. Reverberated and resonating musical sounds are directed forwardly from the resonating chamber in response to selective vibration of one or more of the tubes.

13 Claims, 10 Drawing Sheets

(56) References Cited

U.S. PATENT DOCUMENTS 5,334,797 A * 8/1994 Niedge ..... G10F 1/06
84/86
9,773,482 B2 * 9/2017 Keller ..... G10D 13/08

* cited by examiner

REVERBERATING PERCUSSION INSTRUMENT

CROSS-REFERENCE TO RELATED APPLICATIONS

This application is a U.S. national phase filing under 35 U.S.C. § 371 of PCT/IL2019/050220 filed on Feb. 27, 2019 and entitled "A REVERBERATING PERCUSSION INSTRUMENT," which claims priority to Israeli Patent Application number 257804 filed on Feb. 28, 2018, the disclosures of which are incorporated herein by reference in their entirety.

FIELD OF THE INVENTION

The present invention relates to the field of musical instruments. More particularly, the invention relates to a reverberating percussion instrument.

BACKGROUND OF THE INVENTION

Some reverberating percussion instruments are known, such as gongs and bells; however, they do not produce a distinct pitch and therefore do not serve harmonic functions in music, restricting their use in playing a melody.

The Kailani instrument, which has an open hexagonal, outer peripheral support in which are mounted a plurality of tubes of different lengths, is a prior art reverberating percussion instrument of the idiophone type. However, each of the tubes is mounted by a filament fixedly attached to the support and to a pin welded to the interior of the tube and is therefore not tunable and not readily replaceable. Also, the open nature of the peripheral support limits the duration of each reverberation, and also results in omnidirectional reverberations which are generally directed away from the audience listening to the played music.

GB 597283 and U.S. Pat. No. 9,330,644 also disclose pitched reverberating percussion instruments of the idiophone type which produce reverberations of limited duration.

It is an object of the present invention to provide a reverberating idiophone that produces pitched reverberations of a longer duration than that of the prior art.

It is an additional object of the present invention to provide a reverberating idiophone that produces pitched reverberations of a specific directivity.

It is an additional object of the present invention to provide a reverberating idiophone that is readily tunable.

Other objects and advantages of the invention will become apparent as the description proceeds.

SUMMARY OF THE INVENTION

The present invention provides a reverberating percussion instrument for producing long-duration pitched reverberations, comprising a resonating chamber of a completely smoothly contoured configuration to facilitate generation of long-duration pitched reverberations, and a plurality of hollow and substantially mutually parallel vibratable tubes of different lengths, each of which being suspended from an element of said resonating chamber by a tensioned filament at each longitudinal end thereof, wherein reverberated and resonating musical sounds are directed forwardly from said resonating chamber in response to selective vibration of one or more of said tubes.

The resonating chamber is preferably of a completely rounded periphery, such as being concave, is rearwardly positioned, and is configured with a peripheral and forwardly projecting support frame from which the plurality of vibratable tubes are suspended.

In one embodiment, the percussion instrument further comprises a tensioning system for tensioning the filament on which each vibratable tube is suspended. The percussion instrument comprises a tensioning device positioned externally to, and in movable engagement with, the resonating chamber support frame, a support post adapted to be releasably fixed within an interior of a corresponding vibratable tube, at one longitudinal end thereof, and a fastener for releasably fixating said support post to the support frame, wherein a corresponding filament fed through an aperture formed in the support frame is connected to said tensioning device and is adapted to be wound about said support post.

In one embodiment, the percussion instrument further comprises a vibrating elastic membrane which is stretched over the resonating chamber support frame, facilitating operation in a membranophone mode, an idiophone mode or in a combined membranophone and idiophone mode.

In one embodiment, the percussion instrument further comprises a plate fixed to the support frame, at a region thereof which is rearwardly spaced from the vibratable tubes and is forwardly spaced from the concave surface of the resonating chamber, to define a soundbox therebetween. A single aperture may be formed in the plate, to serve as a sound hole for the soundbox.

DETAILED DESCRIPTION OF THE INVENTION

The present invention is a novel reverberating percussion instrument of the idiophone type for producing average long-duration musical sound reverberations of approximately 40 seconds or more, e.g. 45 seconds. The reverberating percussion instrument has a rear resonating chamber to direct the produced reverberated musical sounds in a specific direction.

Figure 1:
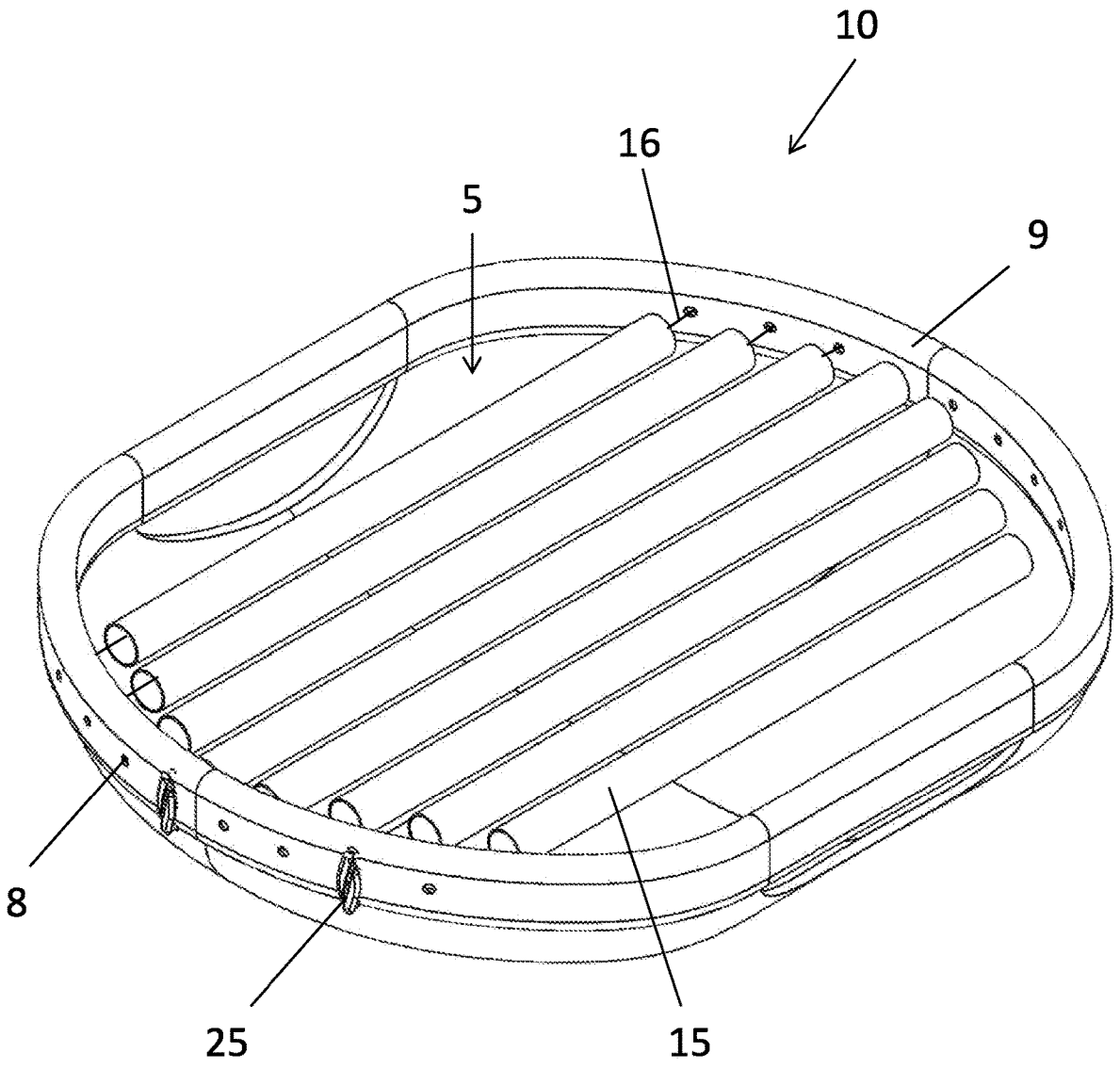
FIG. 1 is a perspective view from above of a reverberating percussion instrument, according to one embodiment of the present invention.

FIG. 1 illustrates reverberating percussion instrument (hereinafter referred to as the "instrument" for brevity), generally indicated by numeral 10, according to one embodiment of the present invention. Instrument 10 comprises resonating chamber 5, a plurality of hollow and substantially mutually parallel tubes 15 of different lengths, e.g. made of aluminum, which are suspended from a peripheral and forwardly projecting support frame 9 of resonating chamber 5 by a tensioned filament 16, e.g. made of polyester or Kevlar, at each longitudinal end of a tube and fed through an aperture 8 formed in support frame 9, and a tensioning device 25 at each longitudinal end of a corresponding tube 15, only two tensioning devices 25 being shown for purposes of clarity. Eight tubes 15 are shown to define the tones of a musical scale, although any other number of tubes may be employed.

The tubes 15 struck by a dedicated striking device, such as a mallet, e.g. having a soft head made of silicon, vibrate, and may also move longitudinally depending on the tension of the filaments, to produce a specific pitch. The acoustic waves emanating from the vibrating tubes are received within the enclosed space of resonating chamber 5, which then reverberate in response to the large number of successive reflections that reflect from a resonating chamber surface, so that the reverberated musical sounds continue after termination of the initial percussed sound and then decay after being absorbed by the resonating chamber surface.

Resonating chamber 5 has a concave and completely smoothly contoured configuration that resists, or completely eliminates, any dampening and diffusing effects which are characteristic of the influence of discontinuities found in prior art instruments and that enhances acoustic resonance in conjunction with the resonant frequencies of the various tubes 15. As acoustic resonance is produced within resonating chamber 5 due to the presence of reverberation-derived standing waves, each tube 15 may be suspended at the location of an aperture 8 corresponding to a calculated nodal point at which the amplitude of the standing wave is a minimal value. The vibration of tubes 15 may be advantageously maximized when the tubes are suspended in this fashion.

Resonating chamber 5 may have a single concave surface, e.g. made from bamboo, from which the acoustic waves reflect to produce the pitched reverberations. Alternatively, resonating chamber 5 may be comprised of a plurality of sections which are suitably interconnected to facilitate long-duration pitched reverberations. The interconnecting elements, which may be concealed, may be rigid, flexible, adhesively or sewably connected, fixed or replaceable.

Figure 2:
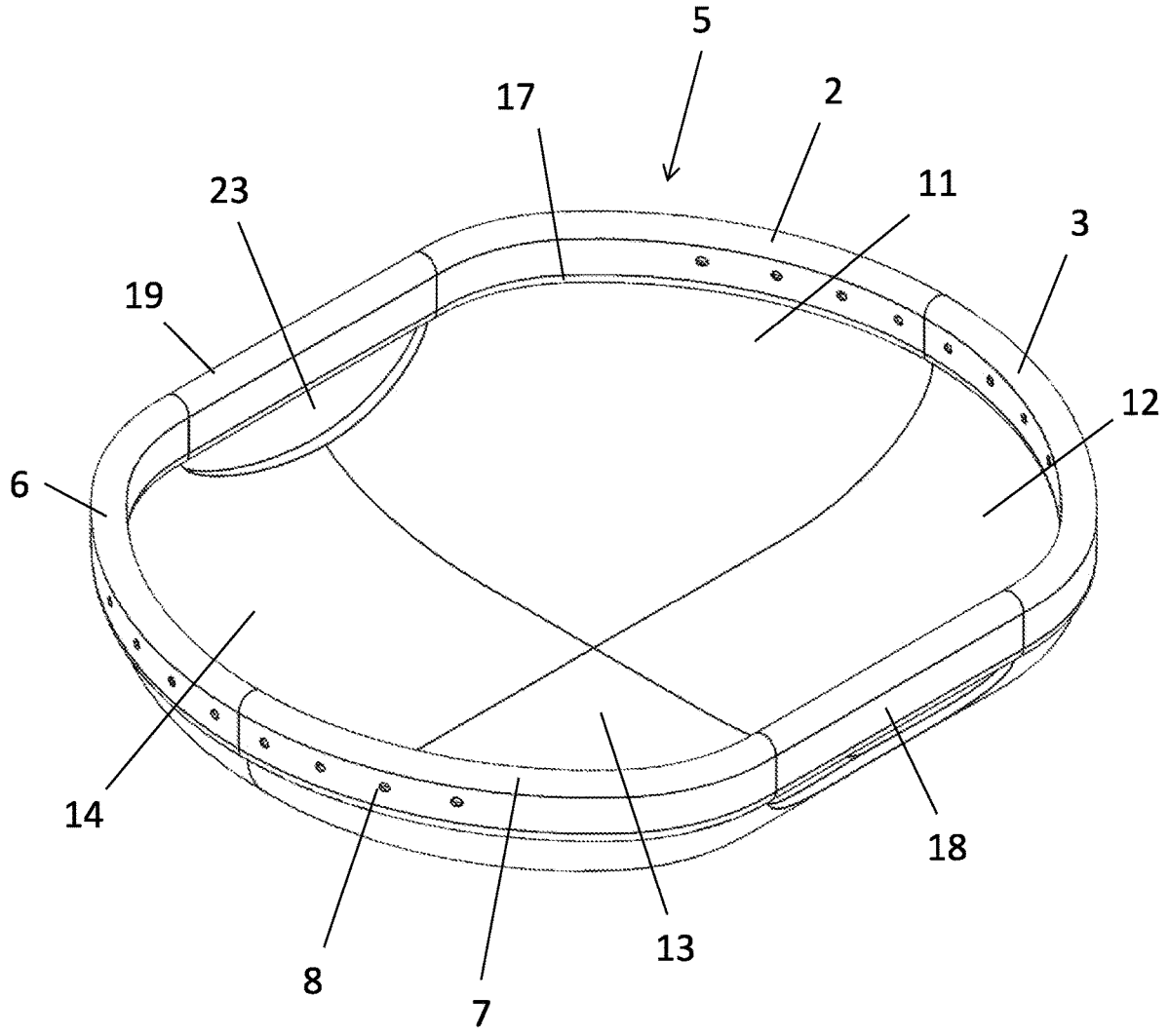
FIG. 2 is a perspective view from above of the instrument of FIG. 1, shown without the vibratable tubes.

When rearward resonating chamber 5 is comprised of a plurality of sections, as shown in FIG. 2, each section may be made of a different material in order to pinpoint desired reverberation characteristics. For example, four concave sections 11-14 may be interconnected to define a composite, rounded resonating chamber surface. Each support frame portion forwardly projecting from a corresponding concave section may also be made from a different material in order to pinpoint desired reverberation characteristics. For example, support frame portions 2-3 and 6-7 are metallic, e.g. made from aluminum, and both support frame portion 18 interposed between portions 3 and 7 and support frame portion 19 interposed between portions 2 and 6 constituting handles may be wooden for ease in manipulating the instrument. A portion of each concave section 11-14 may be provided with a cutout, or may be preformed, to define an opening 23 which assists in grasping the handle. Various accessories such as a microphone may be attached to one or more of the handles.

Also, an additional tone-controlling layer provided with dedicated acoustic material may be affixed to each of sections 11-14, while preferably retaining the concavity of resonating chamber 5. The tone-controlling layer may be uniform, or alternatively may be spatially specific in a surrounding matrix. For example, a portion of the tone-controlling layer may be made of sound dampening material or sound absorbing material positioned below all of the tubes or below specific tubes.

Each of the support frame portions may be substantially perpendicular to the forward border 17 of each concave section for ease in feeding a tensionable filament through a corresponding aperture 8, although any other suitable disposition is also within the scope of the invention.

The concave and completely smoothly contoured resonating chamber advantageously imparts the instrument with surprisingly high mechanical strength that is resistant to mechanical damage caused by impact or to an excessive force applied by a performer to the support frame. The relatively large interior of the resonating chamber facilitates positioning of the vibratable tubes therewithin, while not protruding from, and being protected by, the support frame.

The compact instrument configuration promotes portability, and also permits shorter tube lengths to be employed relative to the prior art Kailani instrument in order to generate the same pitch, for example the 440-Hz Stuttgart pitch. Exemplary dimensions of the instrument are a maximum length of 57 cm, a maximum width of 49 cm and a maximum depth of 11 cm.

The instrument may be comfortably positioned on the lap of the performer, to facilitate for example two-handed playing. Alternatively, the instrument may be substantially vertically oriented, for example while supported on a stand, to direct the produced reverberated musical sounds towards the audience listening to the performer, or positioned in any other desired fashion.

In another embodiment, the instrument is converted to a membranophone by means of a vibrating elastic membrane, e.g. made of Lycra®, which is stretched over the resonating chamber support frame.

Figure 7:
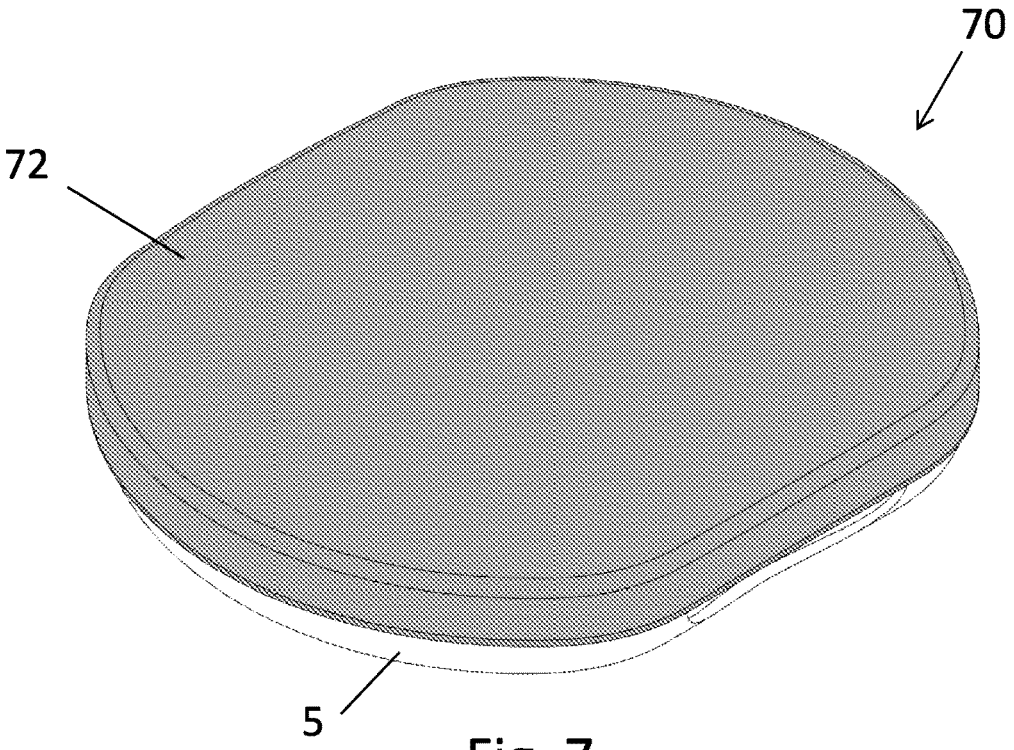
FIG. 7 is a perspective view from above of a reverberating percussion instrument, according to another embodiment of the invention.

As shown in FIG. 7, instrument 70 comprises an elastic membrane 72 which is stretched over the entire resonating chamber support frame. Membrane 72 may be selectively struck by a dedicated striking device or by the hands of a performer without striking the vibratable tubes, to produce a tuned pitched sound in conjunction with resonating chamber 5.

Figure 8:
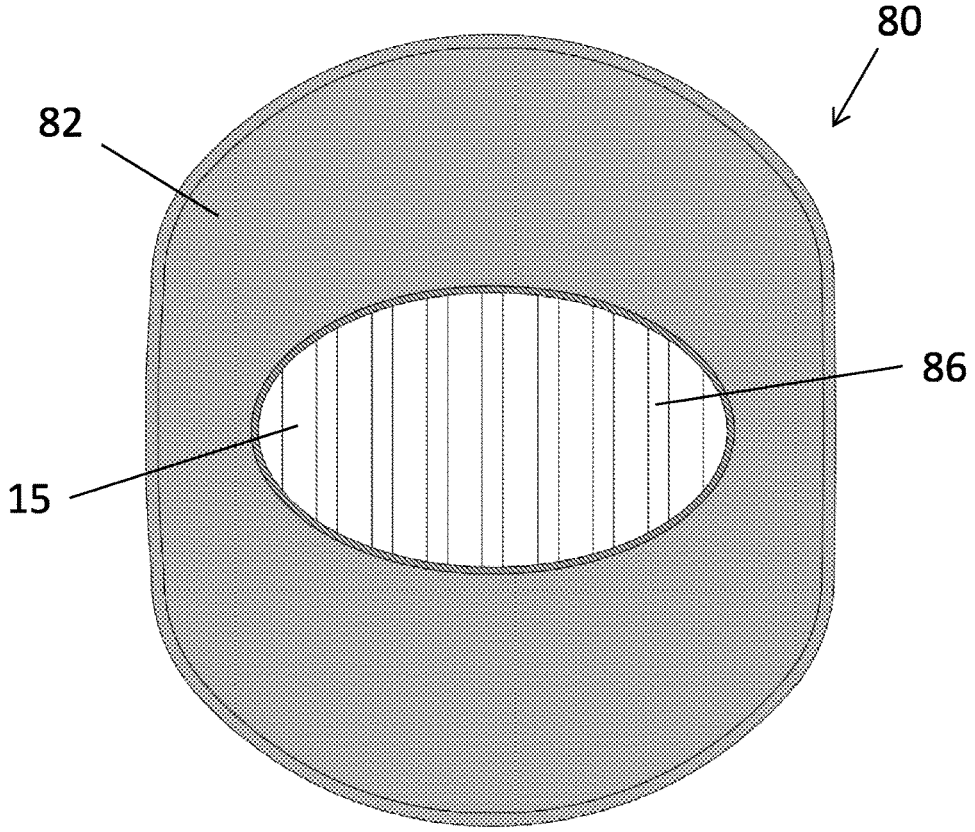
FIG. 8 is a top view of a reverberating percussion instrument, according to another embodiment of the invention.

Instrument 80 illustrated in FIG. 8 has an elastic membrane 82 similar to elastic membrane 72 of FIG. 7, but formed with a central aperture 86, e.g. elliptical, by which the plurality of suspended vibratable tubes 15 may be accessed. Instrument 80 may be played in a membranophone mode by which only membrane 82 is caused to vibrate, while the produced sound is different than produced by instrument 70 of FIG. 7 as a result of the presence of aperture 86. Alternatively, instrument 80 may be played in an idiophone mode by which only tubes 15 are caused to vibrate, while the produced sound is modified, such as by being dampened, by membrane 82. Instrument 80 may also be played in a combined mode by striking, or otherwise interacting with, membrane 82 in such a way that one or more tubes 15 are also caused to vibrate, to produce acoustic resonance in conjunction with both the sound produced by tubes 15 and by the sound produced by membrane 82.

Figure 9B:
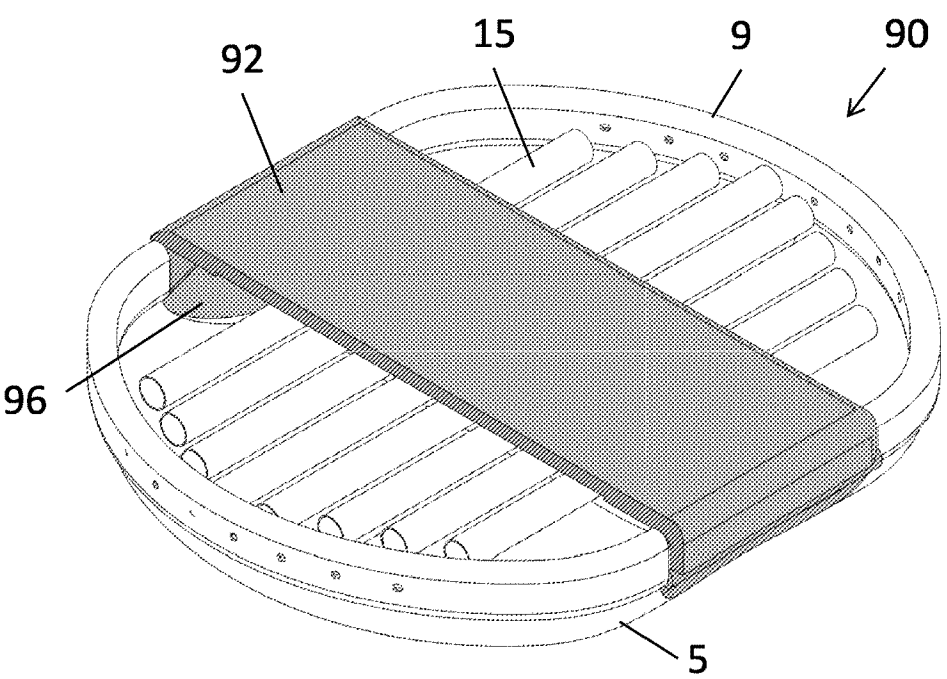
FIG. 9B is a perspective view from above of the instrument of FIG. 9A.
Figure 9A:
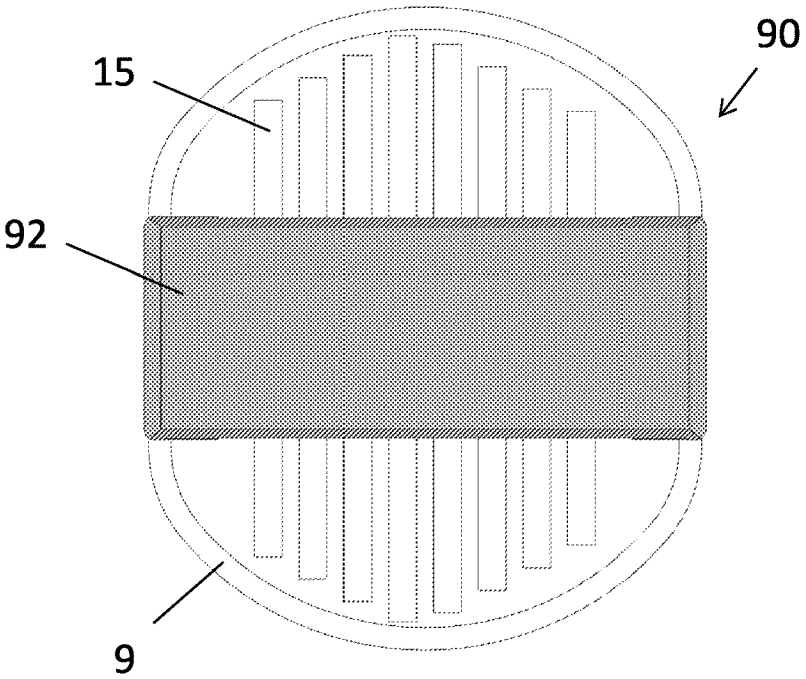
FIG. 9A is a top view of a reverberating percussion instrument, according to another embodiment of the invention.
Figure 9C:
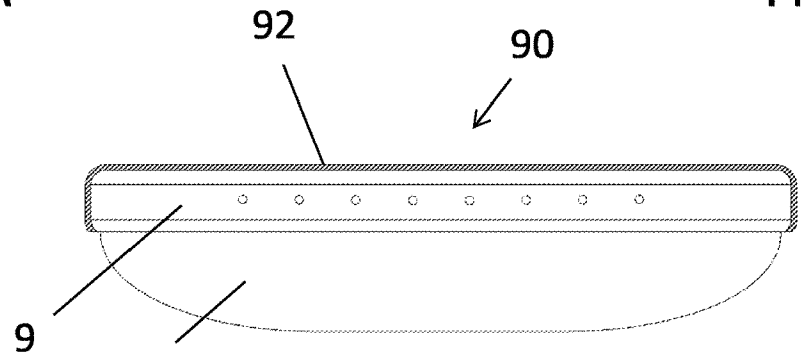
FIG. 9C is an end view of the instrument of FIG. 9A.

Instrument 90 illustrated in FIGS. 9A-C has an elongated elastic membrane 92 which is stretched over a portion of resonating chamber support frame 9, to selectively modify the long-duration pitched reverberations generated by the vibratable tubes 15. Elongated membrane 92 may be stretchedly secured to the handles of support frame 9, after the longitudinal ends thereof 96 are introduced into the corresponding handle-proximate opening 23 (FIG. 2) formed in the concave surface of resonating chamber 5 and are attached by Velcro® elements to the rearward face of elongated membrane 92. Elongated membrane 92, after being stretchedly secured to the handles, may be separated from support frame 9 by a small distance of approximately 1 cm, to facilitate sound generation in a membranophone mode, an idiophone mode or in a combined mode.

Figure 3A:
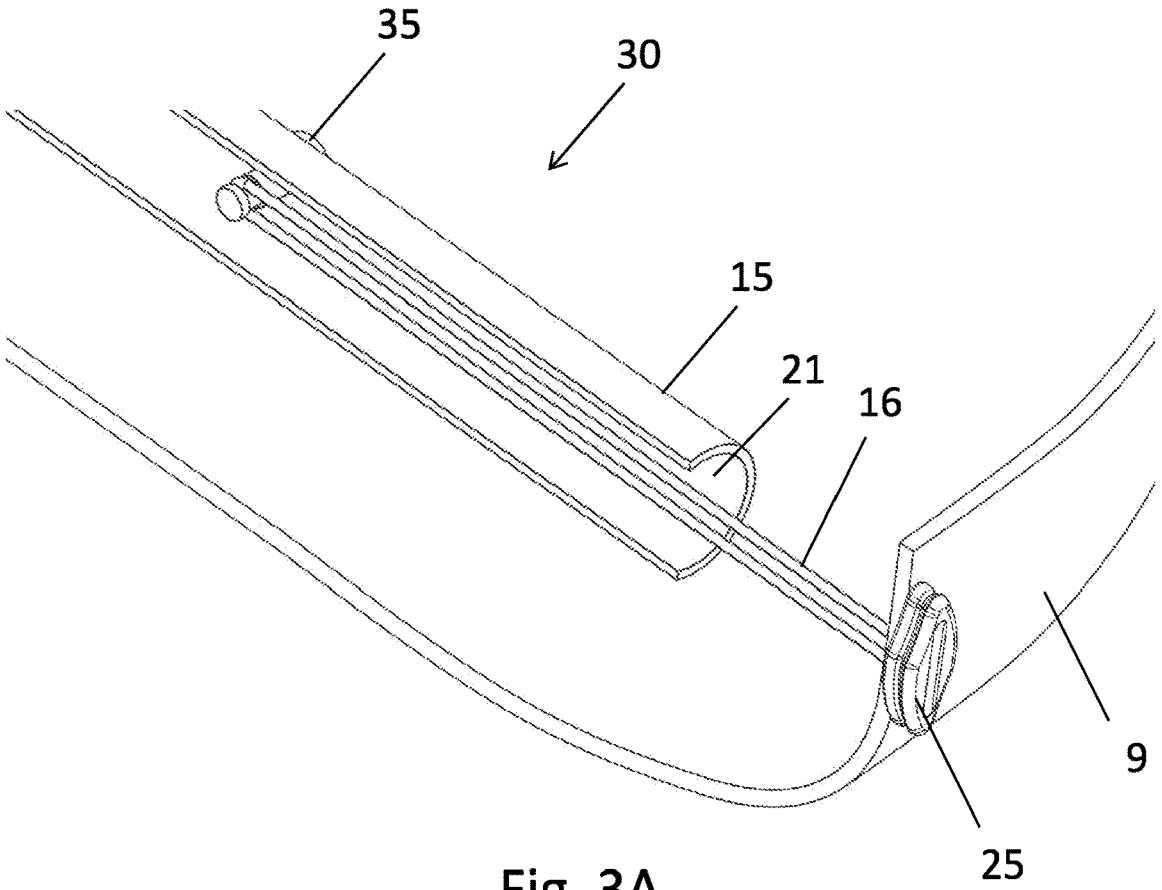
FIG. 3A is a perspective, cross-sectional view of a portion of the instrument of FIG. 1, showing a filament tensioning system.
Figure 3B:
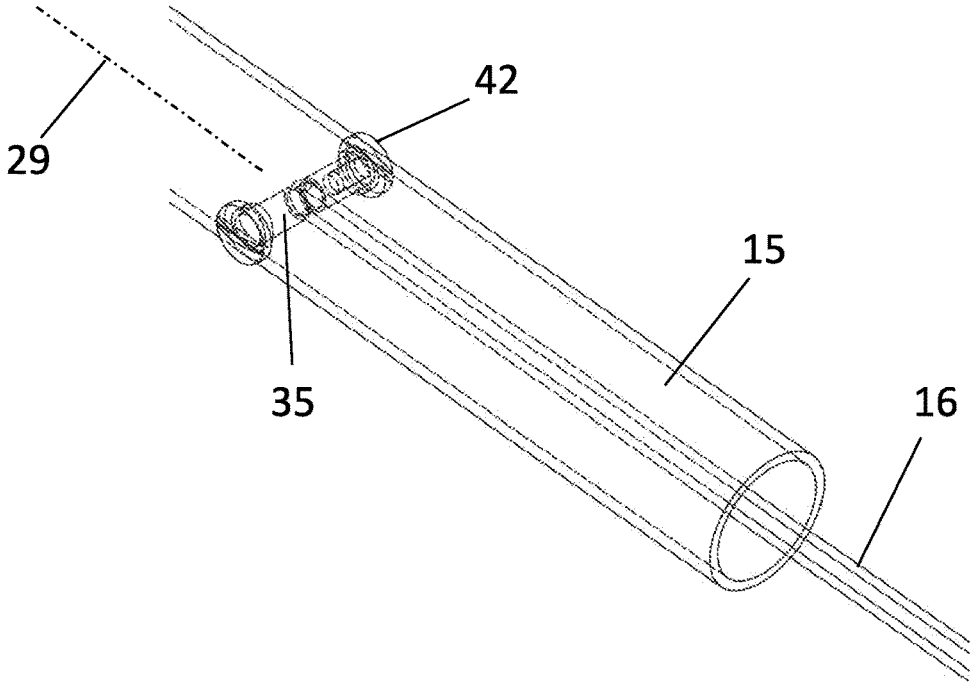
FIG. 3B is a transparent, perspective view of a longitudinal end of a vibratable tube, showing a post used in conjunction with the filament tensioning system of FIG. 3A being in fixated relation with the tube.

FIGS. 3A-B illustrate a user-friendly tensioning system 30 for tensioning the filament 16 on which each vibratable tube 15 is suspended, in order to achieve a desired tone.

Tensioning system 30 comprises tensioning device 25 positioned externally to, and in movable engagement with, the resonating chamber support frame 9, support post 35 adapted to be releasably fixed within the interior 21 of a vibratable tube 15, at one longitudinal end thereof, a corresponding filament 16 extending to both tensioning device 25 and support post 35 and adapted to be wound by one or more turns about support post 35, and fastener 42 for releasably fixating support post 35. Two diametrically opposite bores are formed in the wall of vibratable tube 15, allowing support post 35 to be substantially perpendicular to the longitudinal axis 29 of vibratable tube 15. The two bores may be formed at the sides of a tube 15 which are proximate to an adjacent tube, or, alternatively, may be formed in forward and rearward portions, respectively, of the tube wall so that fastener 42 inserted through the forward bore will be accessible to the user.

Figure 4:
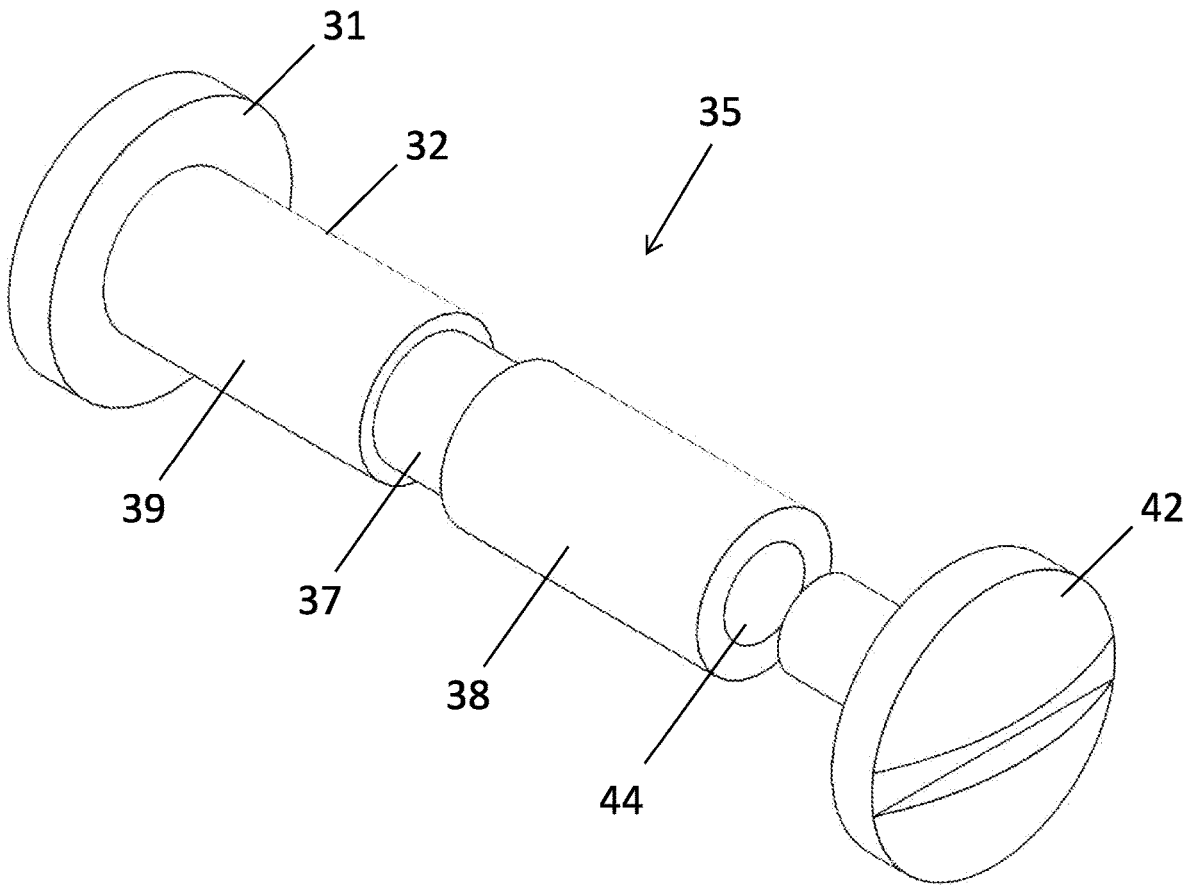
FIG. 4 is a perspective view of a support post used in conjunction with the tensioning system of FIG. 3A.

As shown in FIG. 4, support post 35 has a tubular periphery 32 extending perpendicularly from base 31, e.g. circular, although the invention is also applicable to other cross sectional configurations. A central recessed region 37 is defined between first thickened portion 38 and second thickened portion 39 and is recessed from tubular periphery 32. First thickened portion 38 is insertable through the second bore, which has a diameter only slightly larger than base 31. Fastener 42 is inserted through the first bore, which may be considerably smaller than the second bore, is theadedly attached to the inner wall 44 of first portion 38, or attached thereto by any suitable means well known to those skilled in the art, in order to immobilize support post 35. The length of support post 35 may be such that first portion 38 contacts the inner face of the tube wall and base 31 is received within, and surrounded by the wall of, the second bore, in order to provide additional means of movement restriction.

The height of central recessed region 37 between first portion 38 and second portion 39 is only slightly greater than the thickness of the wound filament, to prevent unwanted filament movement. The filament may be continuously wrapped around central recessed region 37 by a partial turn, as shown in FIG. 3A. Alternatively, one end of the filament may be tied to a different portion thereof after being slightly wound about recessed region 37, to prevent filament separation, while allowing the filament to wound by a plurality of turns about recessed region 37. Central recessed region 37 preferably coincides with the longitudinal axis 29 of vibratable tube 15, to ensure that all vibratable tubes will remain in a mutually parallel orientation even when longitudinally displaced during a tensioning operation.

Figure 5A:
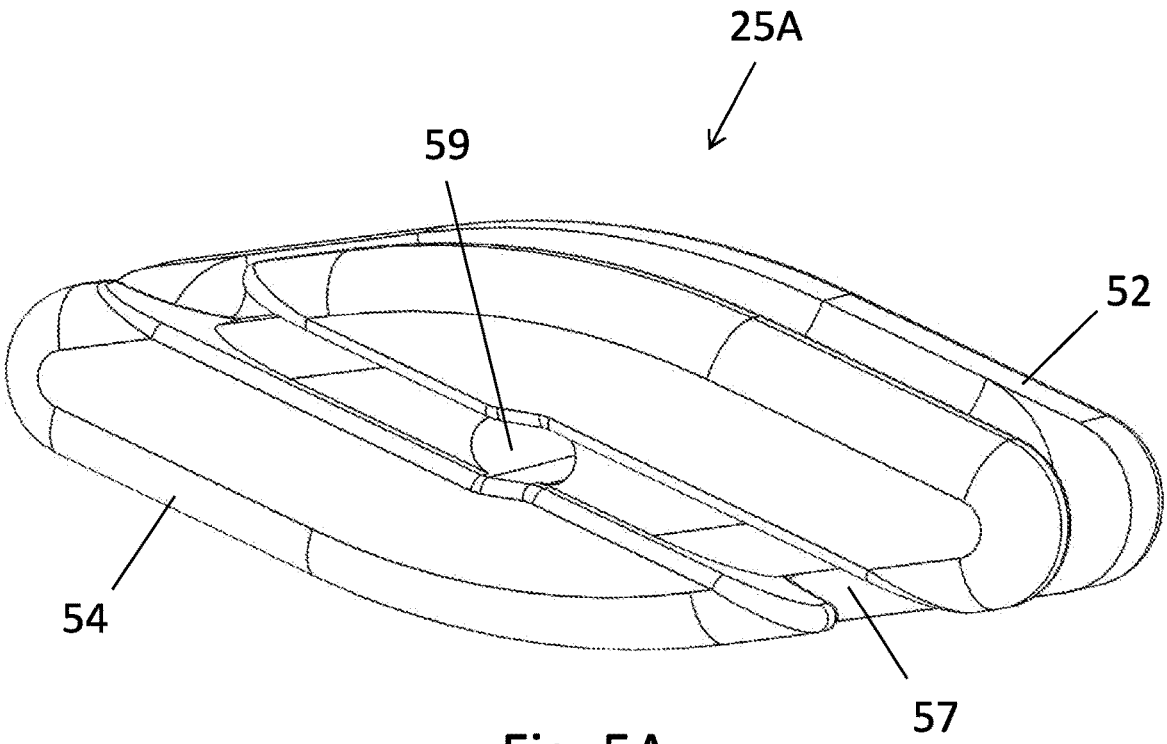
FIGS. 5A and 5B are two perspective views from different sides, respectively, of a tensioning device used in conjunction with the tensioning system of FIG. 3A.
Figure 5B:
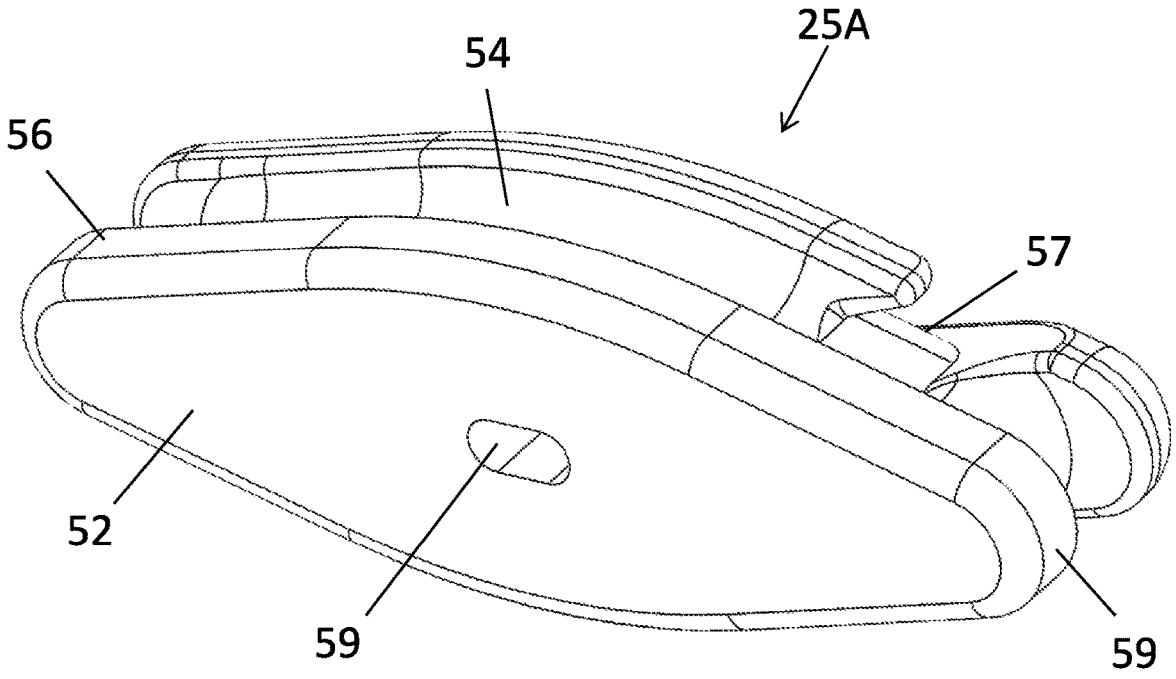

One embodiment of a tensioning device 25A is illustrated in FIGS. 5A-B. Tensioning device 25A has two mutually parallel elliptical sections 52 and 54 and an interconnecting reel (not shown) of reduced dimensions therebetween about which the tensionable filament is able to be wound. A slotted guide 57 is formed in section 54 to guide the filament to the reel. A through-hole 59 to assist in connecting the filament to tensioning device 25A and also functioning as a center of rotation is formed within elliptical sections 52 and 54 and the reel, preferably at the intersection of the major and minor axes of the elliptical sections, or at any other convenient region.

As shown in FIGS. 1 and 3A, the tensioning device is positioned such that the elliptical sections are at an angle to resonating chamber support frame 9, such as at a perpendicular disposition thereto. At this disposition, the filament exiting an aperture 8 of support frame 9 is able to be wound onto, or unwound from, the spool in order to achieve a desired filament tension. If the filament tension is not optimal, as evidenced by the pitch emitted by the corresponding vibratable tube, the tensioning device is rotated about through-hole 59 until the desired tension is achieved. Thus the instrument may be controllably and satisfactorily tuned.

During rotation of tensioning device 25A, the rounded peripheral surface 56 of an elliptical section slidably engages support frame 9 to facilitate continuous and unhindered rotation. Following cessation of a tensioning operation, a region of rounded peripheral surface 56, particularly the rounded tip 59 coinciding with the major axis and having a smallest radius of curvature, is engaged with support frame 9 by localized pressure to resist reverse rotation of the elliptical section and slackening of the filament.

Figure 10A:
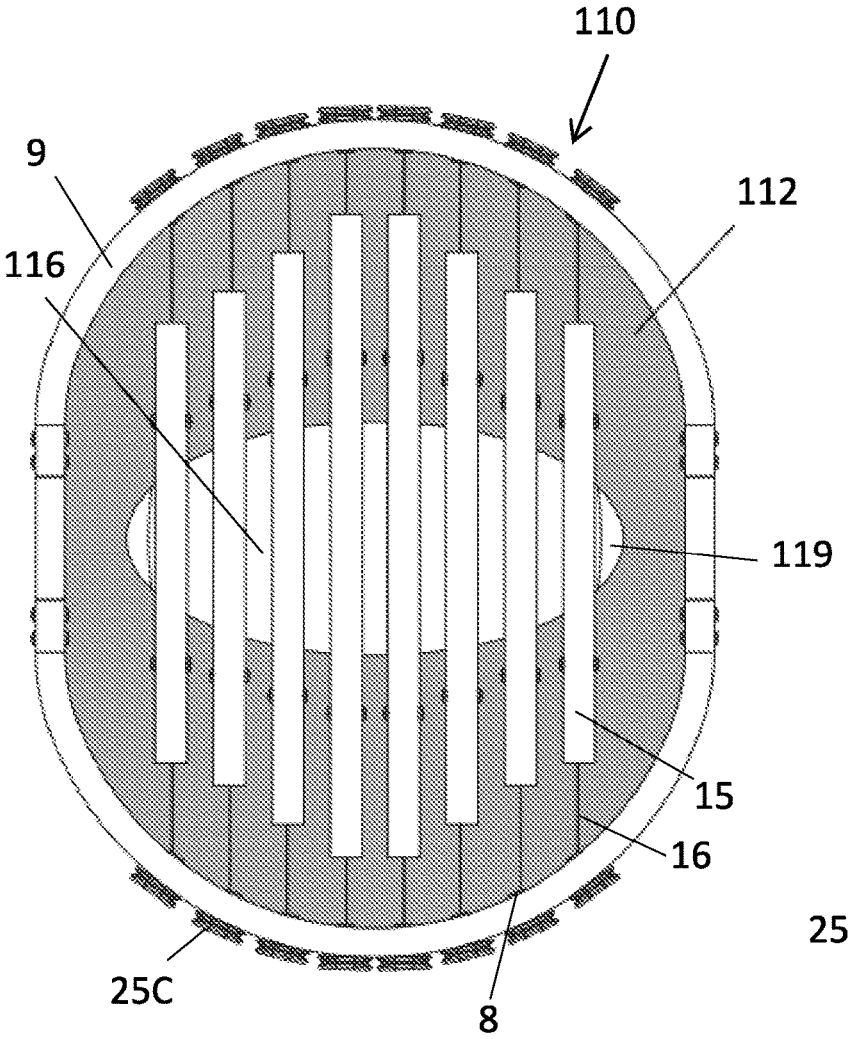
FIG. 10A is a top view of a reverberating percussion instrument, according to another embodiment of the invention.
Figure 10C:
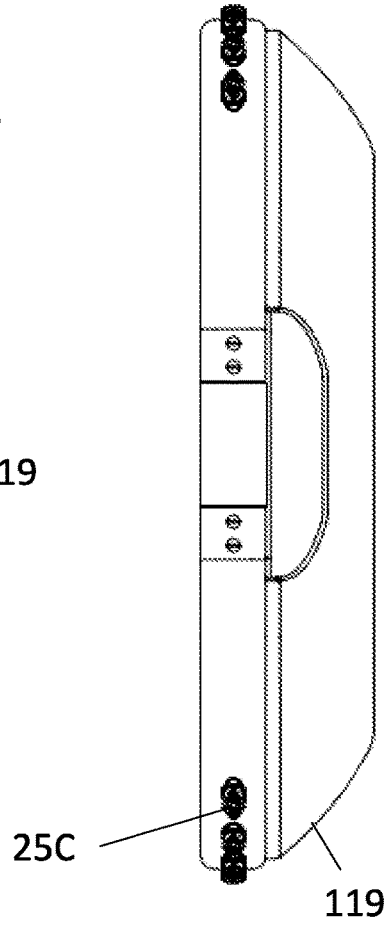
FIG. 10C is a side view of the instrument of FIG. 10A.
Figure 10B:
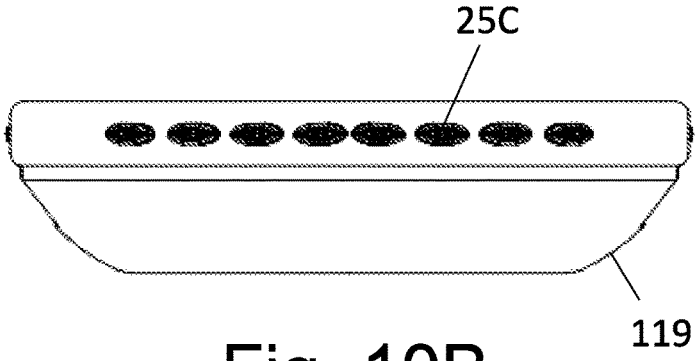
FIG. 10B is an end view of the instrument of FIG. 10A.
Figure 11A:
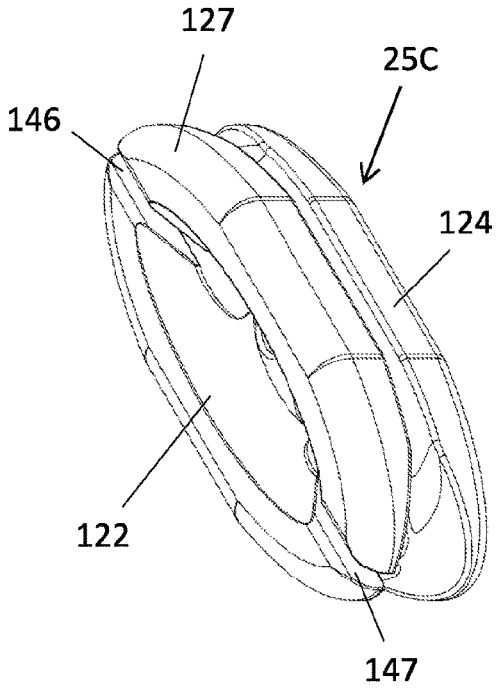
FIG. 11A is a perspective view from the front of another embodiment of a tensioning device.
Figure 11B:
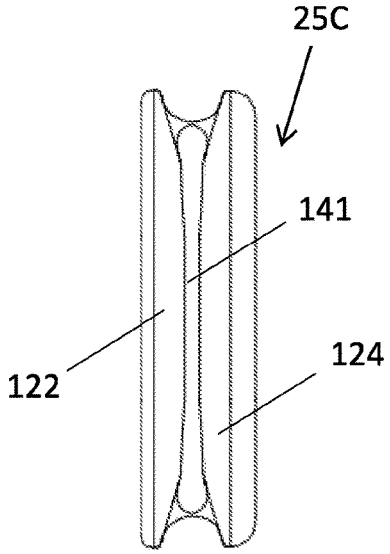
FIG. 11B is a top view of the tensioning device of FIG. 11A.
Figure 11C:
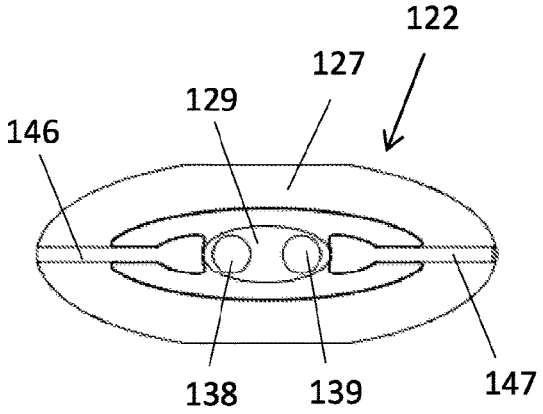
FIGS. 11C and 11D are a view from two different sides, respectively, of the tensioning device of FIG. 11A.
Figure 11D:
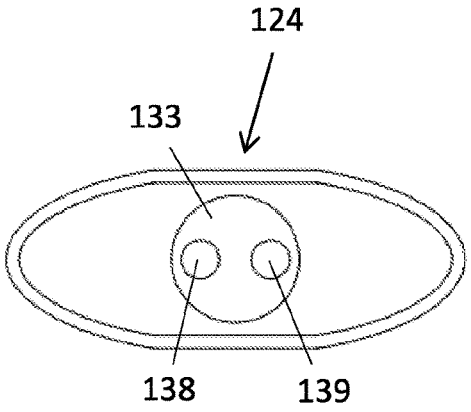

Alternatively, tensioning device 25A is positioned such that the elliptical sections are parallel to resonating chamber support frame 9 such that a wide-area region of one of the elliptical sections, for example section 52, is flush and in movable engagement with support frame 9, to resist reverse rotation, similar to the arrangement shown in FIGS. 10A-C. The filament exiting an aperture 8 of support frame 9 is fed through through-hole 59 to elliptical section 54, directed through slotted guide 57 to the reel, and is wound thereabout after being tied.

The elliptical sections, together with rounded peripheral surface 56, have an ergonomic shape that can be comfortably embraced in the palm or contacted by the fingers of a user while being rotated.

If it desired to replace a vibratable tube, if damaged or to generate a different pitched sound with a different material or with a different sized tube, the tube is easily removable by first detaching the accessible, forwardly positioned fastener 42, removing post 35 from the tube interior and separating filament 16 from central recessed region 37.

Figure 6A:
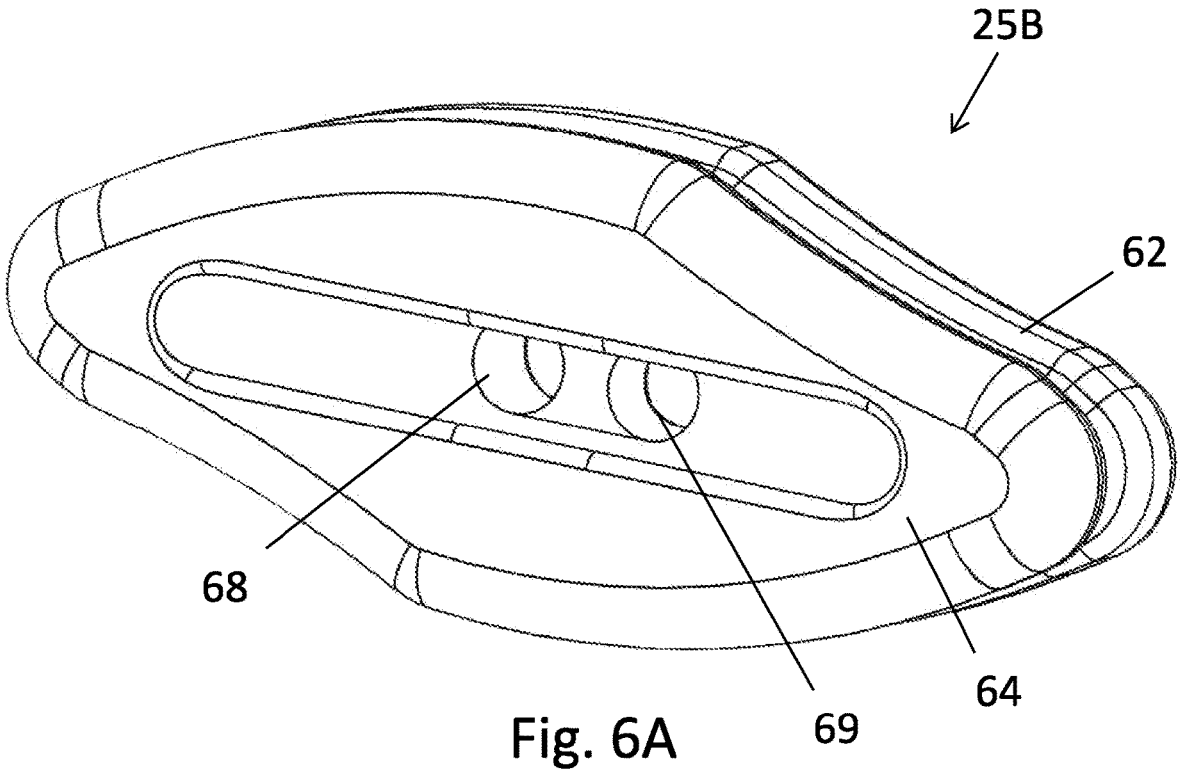
FIGS. 6A and 6B are two perspective views from different sides, respectively, of another tensioning device used in conjunction with the tensioning system of FIG. 3A.
Figure 6B:
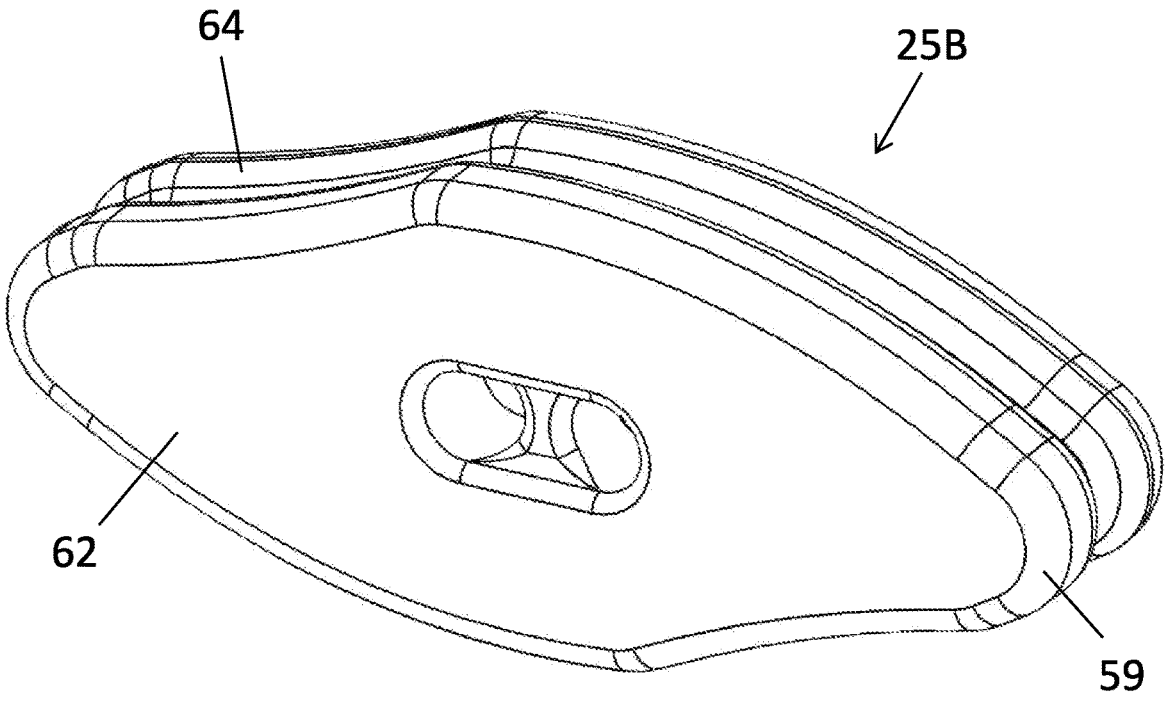

A similar tensioning device 25B with elliptical sections 62 and 64, but with two through-holes 68 and 69 is illustrated in FIGS. 6A-B.

Instrument 110 illustrated in FIGS. 10A-C has a thin plate 112, generally planar, which is fixed to support frame 9, at a region thereof which is sufficiently rearwardly spaced from the apertures 8 to prevent interference with the vibratable tubes 15 or with the filaments 16, each of which is connected to a corresponding tensioning device 25C positioned externally to support frame 9. Plate 112 is spaced from the concave surface 119 of the resonating chamber, which may be formed of a plurality of sections, to define a soundbox therebetween. Plate 112, which may be hard, e.g. made from bamboo, or alternatively may be relatively soft, is adapted to vibrate at a broad range of low frequencies, e.g. 100-500 Hz.

A single aperture 116 is formed in plate 112, and serves as a sound hole for the soundbox by which the vibrational energy produced by the tubes 15 is transmitted to the air within the resonating chamber. The soundbox in turn in turn radiates the received vibrational energy as audible reverberating sound. The sound waves emitted from the soundbox are of an opposite phase as the sound waves incoming from the vibrating tubes 15, so that the emitted sound waves will interfere destructively with the incoming waves and cause the incoming waves to attenuate.

The sound emitted by instrument 110, resulting from the generated pitches and overtones, which may be acoustically amplified, may be pinpointed by selecting the size, shape and relative location of aperture 116, as well as the material and thickness of plate 112 and concave surface 119 and the distance therebetween.

The configuration of tensioning device 25C is illustrated in FIGS. 11A-D. The two elliptical sections 122 and 124 are shown to have a thickened periphery 127 adapted to engage the support frame. Within a plate 129 recessed with respect to periphery 127 in elliptical section 122 are formed two through-holes 138 and 139 through which the filament is fed. A differently shaped plate 133 is formed with the same through-holes in elliptical section 124. The filament is wound about reel 141 positioned between and shorter than elliptical sections 122 and 124. While elliptical section 122 has slotted guides 146 and 147 to guide the filament to reel 141, elliptical section 124 is unslotted.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A reverberating percussion instrument for producing long-duration pitched reverberations, comprising a resonating chamber of a completely smoothly contoured configuration to facilitate generation of long-duration pitched reverberations, and a plurality of hollow and substantially mutually parallel vibratable tubes of different lengths, each of which being suspended from an element of said resonating chamber by a tensioned filament at each longitudinal end thereof, wherein reverberated and resonating musical sounds are directed forwardly from said resonating chamber in response to selective vibration of one or more of said tubes.

2. The percussion instrument according to claim 1, wherein the resonating chamber is of a completely rounded periphery.

3. The percussion instrument according to claim 2, wherein the resonating chamber is concave and rearwardly positioned, and is configured with a peripheral and forwardly projecting support frame from which the plurality of vibratable tubes are suspended.

4. The percussion instrument according to claim 3, wherein each of the plurality of vibratable tubes is suspended at a location of the support frame corresponding to a calculated nodal point of a reverberation-derived standing wave at which the amplitude of the standing wave is a minimal value.

5. The percussion instrument according to claim 3, wherein the resonating chamber has a single concave surface from which acoustic waves reflect to produce long-duration pitched reverberations.

6. The percussion instrument according to claim 5, further comprising a plate fixed to the support frame, at a region thereof which is rearwardly spaced from the vibratable tubes and is forwardly spaced from the concave surface of the resonating chamber, to define a soundbox therebetween.

7. The percussion instrument according to claim 6, wherein a single aperture is formed in the plate, to serve as a sound hole for the soundbox.

8. The percussion instrument according to claim 3, wherein the resonating chamber is comprised of a plurality of interconnected sections to facilitate generation of long-duration pitched reverberations.

9. The percussion instrument according to claim 3, further comprising a tensioning system for tensioning the filament on which each vibratable tube is suspended.

10. The percussion instrument according to claim 9, wherein the tensioning system comprises a tensioning device positioned externally to, and in movable engagement with, the resonating chamber support frame, a support post adapted to be releasably fixed within an interior of a corresponding vibratable tube, at one longitudinal end thereof, and a fastener for releasably fixating said support post to the support frame, wherein a corresponding filament fed through an aperture formed in the support frame is connected to said tensioning device and is adapted to be wound about said support post.

11. The percussion instrument according to claim 3, further comprising a vibrating elastic membrane which is stretched over the resonating chamber support frame.

12. The percussion instrument according to claim 11, which is operable in a membranophone mode, an idiophone mode or in a combined membranophone and idiophone mode.

13. The percussion instrument according to claim 1, which is operable to produce long-duration pitched reverberations of an average duration of approximately 40 seconds or more.

* * * * *